US005553787A

United States Patent [19]

Guginsky

[11] Patent Number: 5,553,787

[45] Date of Patent: Sep. 10, 1996

[54] ELECTRICAL CONNECTOR

[75] Inventor: Frank A. Guginsky, Commack, N.Y.

[73] Assignee: General Signal Corporation, Stamford, Conn.

[21] Appl. No.: 364,309

[22] Filed: Dec. 27, 1994

[51] Int. Cl.[6] ..... H01R 13/595

[52] U.S. Cl. ..... 439/472; 439/535; 439/812; 248/906; 174/65 R

[58] Field of Search ..... 439/810–812, 439/814, 535, 469, 472; 248/27.3, 906; 220/3.2, 3.9, 3.7; 174/65 R

[56] References Cited

U.S. PATENT DOCUMENTS

| | | | |
|---|---|---|---|
| D. 336,282 | 6/1993 | Guginsky | D13/133 |
| 2,326,841 | 8/1943 | Despard | 248/906 |
| 2,659,765 | 11/1953 | Dunn | 220/3.2 |
| 4,629,281 | 12/1986 | Kruger | 439/812 |
| 4,919,370 | 4/1990 | Martin et al. | 248/56 |

OTHER PUBLICATIONS

Brochure by ETP, Berger Industries, Inc., entitled "ETP EMT Speedline Connectors", Jun. 10, 1974.
Brochure by Arlington Industries, Inc., entitled "NM Cable".
Brochure by NEER, entitled "Nonmetallic Sheathed Cable Connectors".
IBM Technical Disclosure Bulletin, "Double Angle Strain Relief Clamp", vol. 3, No. 6, pp. 4–5.

*Primary Examiner*—Gary F. Paumen
*Attorney, Agent, or Firm*—Ohlandt, Greeley, Ruggiero & Perle

[57] ABSTRACT

An electrical connector for use in connecting a substantially flat cable to an outlet box which comprises a connector body having a rectangular or square box configuration. The connector body comprises a top portion having a first tab portion disposed about the front edge of the top portion for connecting the electrical connector to an outlet box; a first side wall connected to the top portion; a second side wall also connected to the top portion; a bottom portion having a second tab portion disposed about the front edge of the bottom portion for connecting the electrical connector to the outlet box; and a rear end having a through-hole therein is connected to both the top and bottom portions; and a saddle and screw for concurrently securing the cable disposed within the connector body and securing the connector body to the outlet box.

14 Claims, 4 Drawing Sheets

ELECTRICAL CONNECTOR

The present invention relates generally to an electrical connector used to secure an electrical wire or cable to an outlet box. The electrical connector preferably has a rectangular or square box configuration and is particularly suited for use with flat, metallic or non-metallic sheathed, multi-conductor cables.

BACKGROUND OF THE INVENTION

Electrical connector manufacturers market various connectors which are suitable for being affixed about flat, non-metallic sheathed, multi-conductor cables without suffering the misalignment associated with the cylindrically-shaped connectors used with armored cables. One such connector is a five-piece connector having a cylindrically-shaped connector body with an annularly threaded portion disposed at one end thereof, the opposite end thereof being a body clamping portion having two threaded mounting holes, a lock nut cooperating with the threaded portion of the body to secure the connector to an outlet box, a cable clamp, and two screws used for securing the cable clamp to the body clamping portion. This conventional five-piece electrical connector is secured to the aforementioned outlet box by inserting the threaded portion of the connector body through a knockout disposed within the side wall of the outlet box and affixing the connector thereto by screwing the lock nut about the threaded portion of the connector body from inside of the outlet box. Thereafter, the cable is passed through the connector body and into the outlet box. The cable is then secured within the electrical connector by screwing the cable clamp to the body clamping portion such that the cable is securely disposed therebetween. The cable clamp and body clamping portion typically have relatively flat inner opposed surfaces which come into contact with the adjacent flat surfaces of the cable, thereby preventing the misalignment of the cable within the electrical connector. Unfortunately, the assembly of a five-piece electrical connector is expensive. Also the physical attachment of the electrical connector to the outlet box requires the electrician to spend a considerable amount of time to secure the connector to the outlet box. That is, the electrician must remove the lock nut from the connector body, insert the threaded portion of the connector body into the hole along the side wall of the outlet box, re-thread the lock nut about the threaded portion of the connector body while holding the connector body in a fixed position relative to the outlet box, insert the flat cable into the connector body, and secure the cable to the connector body by tightening the cable clamp with two screws.

This five-piece conventional electrical connector is costly to fabricate, assemble and install. Therefore, it would be most advantageous to develop an electrical connector which is simple and inexpensive to manufacture, and which is easily installed within an outlet box.

U.S. Pat. No. Des. 336,282 (Guginsky), which issued on Jun. 8, 1993, discloses a three-piece cylindrical electrical connector which can be manufactured from a single stamping and which is easily installed within most conventional electric outlet boxes. The electrical connectors disclosed in U.S. Pat. No. Des. 336,282, however, are more particularly suited for connecting a round-shaped armored cable to an outlet box. Additionally, the cylindrical connector includes an insulating stop disposed about the end of the connector which is adjacent to the outlet box so as to prevent the armored cable from entering the outlet box. The cylindrical cross-section of the electrical connector disclosed in DES. 336,282 is not suitable for use with flat, non-metallic sheathed, multi-conductor cables since it would permit such flat cables to move about and not provide a secure connection therebetween, and not allow the cable sheathing to project into the outlet box.

The present invention overcomes the disadvantages with regard to the above described cylindrical electrical connector. In particular, the rectangular or square box configuration of the electrical connector according to the present invention can also be fabricated from a single piece of material, while using far fewer progressive die stations than are required for cylindrically-shaped connectors. It also does not necessitate the use of the insulating stop, which substantially reduces the material cost of the connector. Moreover, the rectangular or square box configuration of the electrical connect according to the present invention provides a snug fit when a flat, metallic or non-metallic sheathed, multi-conductor cable is disposed therein, thereby avoiding the misalignment of the flat cable which normally occurs when using the conventional cylindrically-shaped connector.

When compared directly to conventional flat cable connectors, the rectangular or square box electrical connector of the present invention can be assembled from just three pieces (i.e., the connector body, saddle and saddle screw), and simply snap fit into the knockout disposed about the side wall of the outlet box without the need for a locking nut to secure it thereto. Moreover, the unique rectangular or square box configuration of the connector according to the present invention only requires the tightening of a single screw to insure that the cable is securely affixed between the saddle and an interior side wall of the connector body. Since both the interior side wall of the connector body according to the present invention and the saddle are substantially flat and in a substantially parallel relationship to one another, the flat, metallic or non-metallic sheathed, multi-conductor cable can be securely clamped therebetween; thereby avoiding the misalignment which would result if one attempted to secure a flat, metallic or non-metallic sheathed, multiconductor cable to an outlet box via the conventional three-piece cylindrical connector.

The present invention also provides many additional advantages which shall become apparent as described below.

SUMMARY OF THE INVENTION

An electrical connector which comprises: a connector body fabricated from a single piece of material into a rectangular or square box configuration. The connector body comprises: a top portion having a first tab portion disposed about the front edge of the top portion for connecting the electrical connector to an outlet box; a first side wall connected to the top portion; a second side wall also connected to the top portion; a bottom portion having a second tab portion disposed about the from edge of the bottom portion for connecting the electrical connector to the outlet box; and a rear end having a through-hole therein is connected to both the top and bottom portions; and a means for concurrently securing the cable disposed within the connector body and securing the connector body to the outlet box.

The means for concurrently securing the cable and connector body comprises an adjustable plate or saddle disposed between the top and bottom portions of the connector body and a means (e.g., a saddle screw) for reciprocally moving the adjustable plate in a substantially parallel plane with respect to the top and bottom portions, wherein the means for reciprocally moving the adjustable plate is also capable of causing the top and bottom portions to move in opposite directions from each other so as to secure the connector body to the outlet box.

Either the top or bottom portion of the connector body comprises a through-hole centrally disposed therein for receiving the saddle screw in a substantially parallel plane with respect to the top and bottom portions. Whichever portion does not include the through-hole, will preferably include an angled stiffening portion disposed substantially adjacent to the rear end of the connector body. Moreover, the adjustable plate also includes a centrally disposed through-hole capable of receiving the saddle screw.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
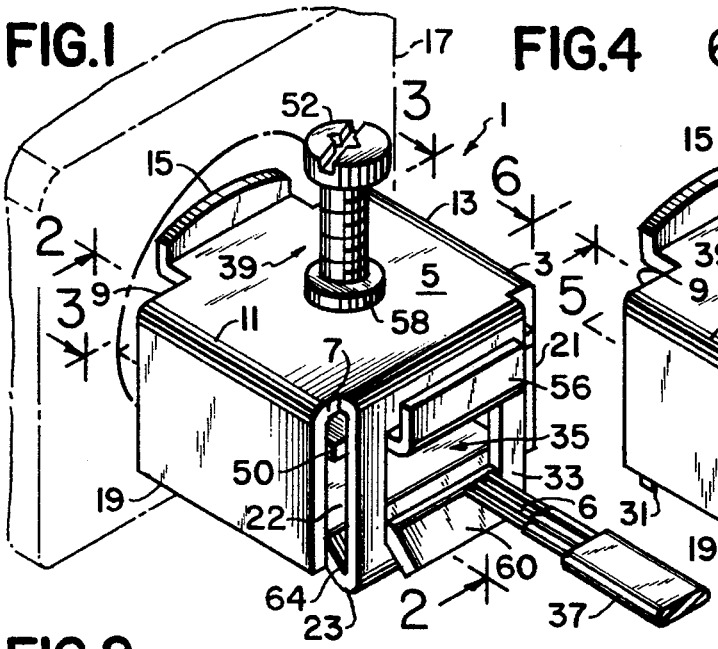
FIG. 1 is a top-left perspective view of the electrical connector according to the present invention as it is disposed within a knockout of an outlet box.
Figure 4:
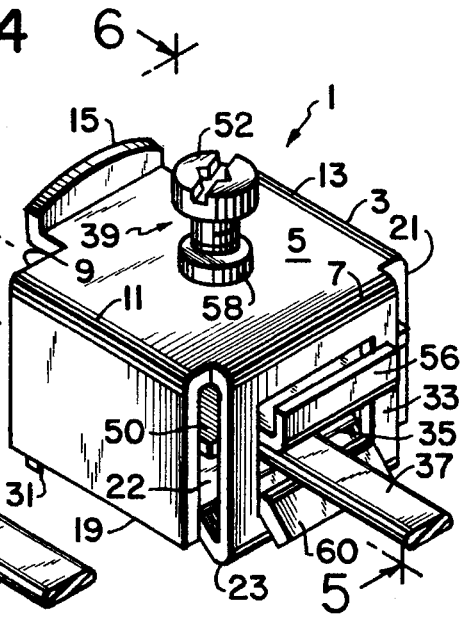
FIG. 4 is a top-left perspective view of the electrical connector of the present invention having a flat, non-metallic sheathed, multi-conductor cable disposed therein.

The present invention is directed to a substantially rectangular, three-piece, cable connector. This cable connector is suitable for terminating a flat, metallic or non-metallic sheathed, multi-conductor cable to an outlet box through a ½' knockout, by way of example.

The present invention can best be described by referring to the drawings wherein FIGS. 1–22 disclose an electrical connector 1 which comprises: a connector body 3, e.g., a metal connector body which is preferably fabricated from a single piece of material into a rectangular or square box-type configuration. Connector body 3 comprising a top portion 5 which has a rear edge 7, a front edge 9, a first side edge 11, a second side edge 13, and a tab portion 15 disposed about front edge 9 of top portion 5 for connecting electrical connector 3 to outlet box 17; a first side wall 19 connected to first side edge 11 of top portion 5; a second side wall 21 connected to second side edge 13 of top portion 5; a bottom portion 22 which comprises a rear edge 23, a front edge 25, a first side edge 27, a second side edge 29, and a tab portion 31 disposed about front edge 25 of bottom portion 22 for connecting electrical connector 3 to outlet box 17; and a rear end 33 which is connected to rear edges (7, 23) of both top and bottom portions (5, 22). Rear end 33 comprises a through-hole 35 for receiving an electrical cable 37 therein; and a means 39 for securing cable 37 disposed within connector body 3. First and second side edges (27, 29) of bottom portion 22 have substantially perpendicular turned-up portions 28 and 30, respectively. Turned-up portions (28, 30) provide stiffening (i.e., structural support) to bottom portion 22.

Means 39 for securing cable 37 comprises an adjustable plate or saddle 50 disposed between top and bottom portions (5, 22) of connector body 3 and a means 52 (e.g., saddle screw) for reciprocally moving adjustable plate 50 in a substantially parallel plane with respect to top and bottom portions (5, 22).

Figure 2:
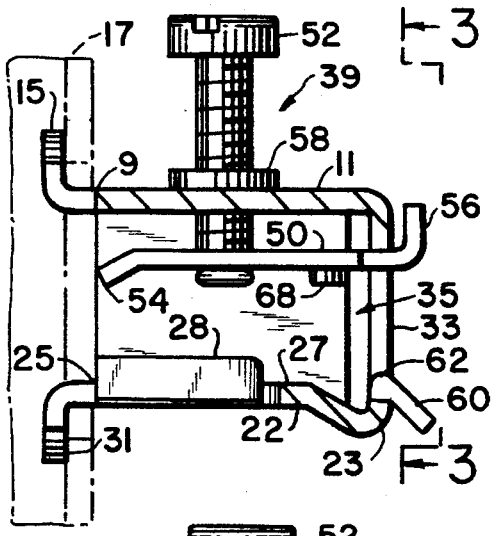
FIG. 2 is an irregular cross-sectional view along line 2—2 of FIG. 1 depicting the electrical connector of the present invention inserted in a knockout of the outlet box and in the open position.
Figure 5:
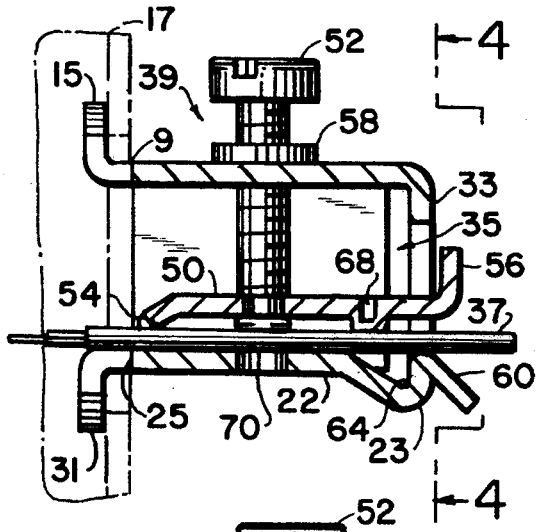
FIG. 5 is a cross-sectional view along line 5—5 of FIG. 4 depicting the electrical connector of the present invention inserted in a knockout of the outlet box and in the closed position with a flat, non-metallic sheathed, multi-conductor cable disposed therein.
Figure 3:
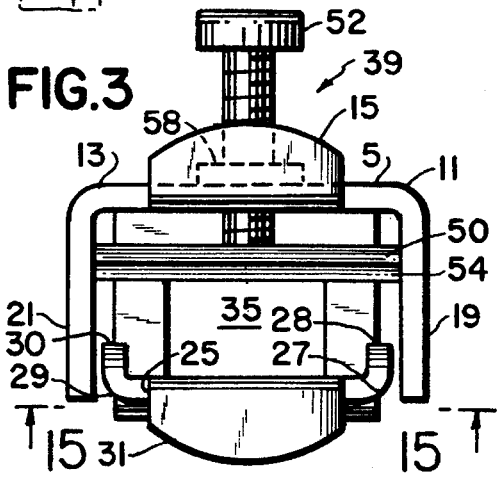
FIG. 3 is an elevation view of the front face of the electrical connector of FIG. 1 shown in the open position and without the cable.
Figure 6:
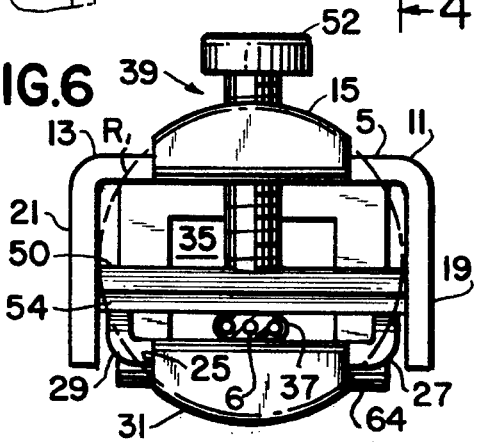
FIG. 6 is an elevation view of the front face of the electrical connector of FIG. 4 shown in the closed position with the cable securely clamped therein, the knockout of the outlet box being shown in phantom.
Figure 7:
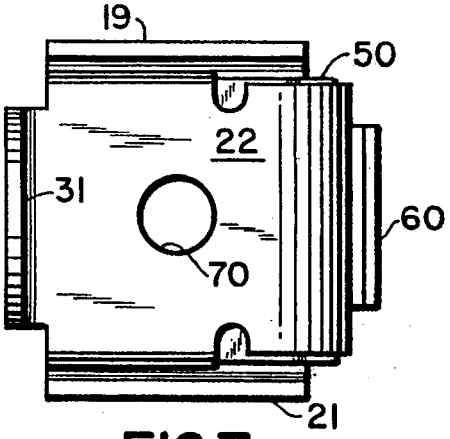
FIG. 7 is a bottom plan view of the electrical connector according to the present invention.
Figure 8:
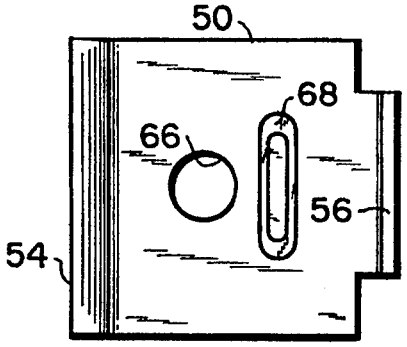
FIG. 8 is a top plan view of the saddle or adjustable plate disposed within the electrical connector according to the present invention.
Figure 9:
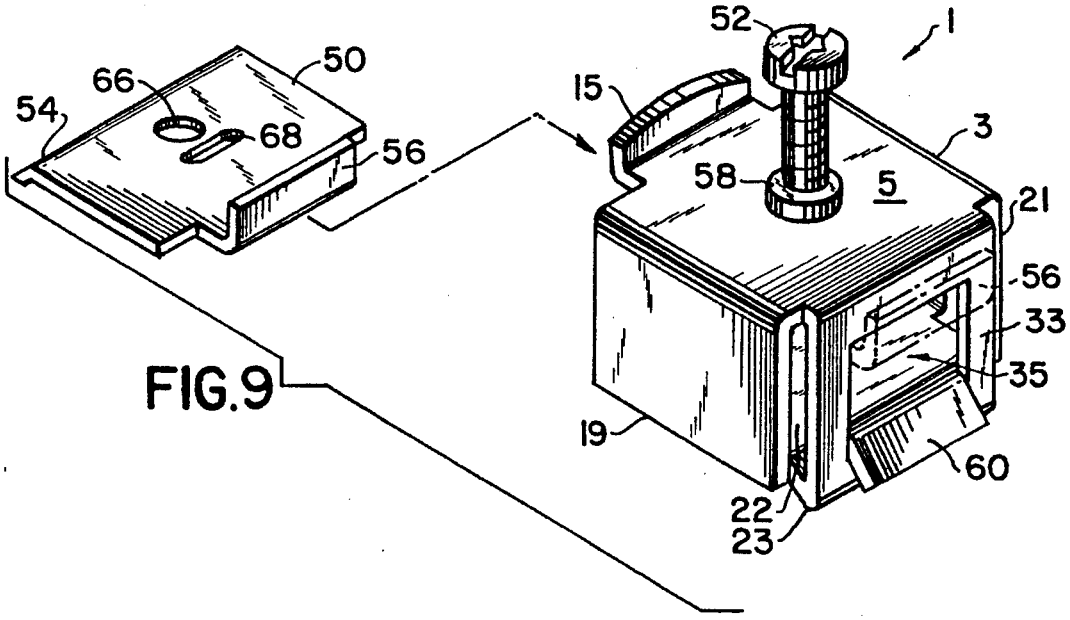
FIG. 9 is top-left perspective exploded view of the electrical connector of the present invention showing the saddle removed therefrom.
Figure 10:
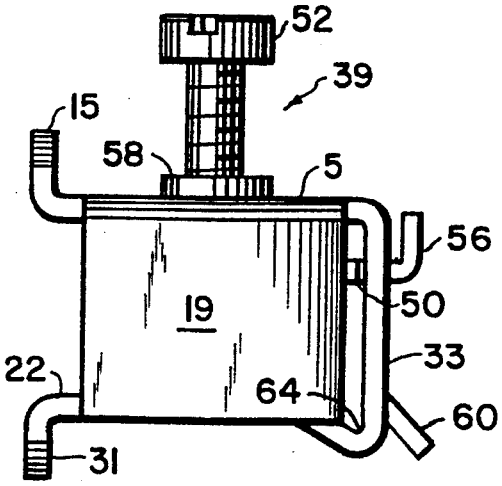
FIG. 10 is a left side elevation view of the electrical connector according to the present invention wherein the saddle screw enters the electrical connector from the top surface thereof and wherein the protective shield or tab of the saddle is pointed upwards.
Figure 11:
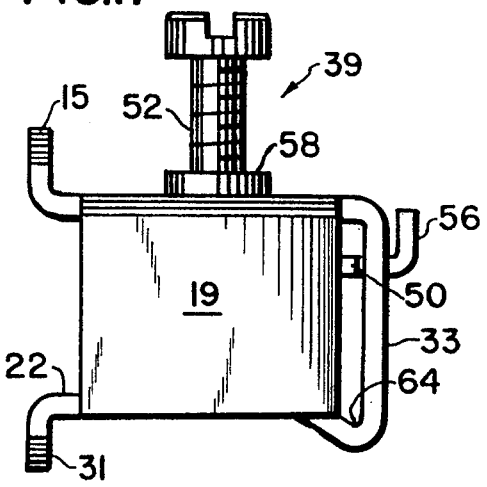
FIG. 11 is a left side elevation view of the electrical connector according to the present invention without a tab disposed on the rear end thereof.
Figure 12:
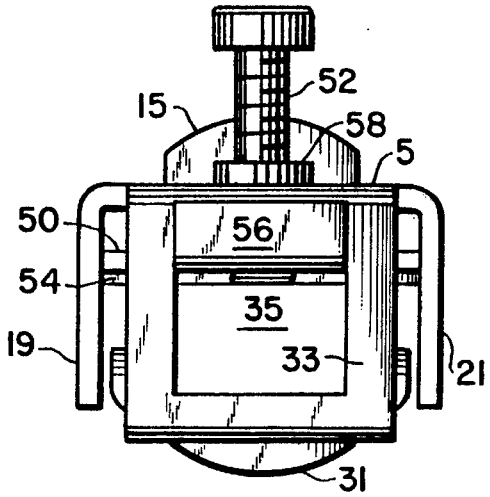
FIG. 12 is a rear end elevation view of the electrical connector according to the present invention without a tab disposed on the rear end thereof.
Figure 13:
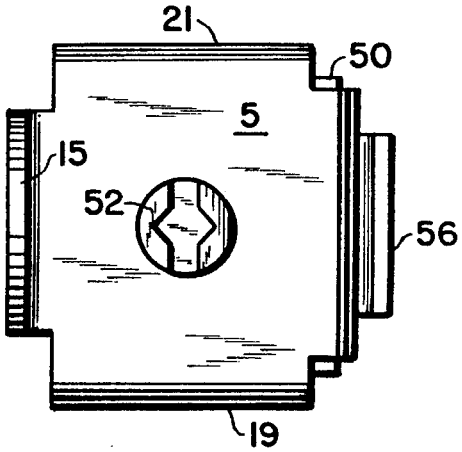
FIG. 13 is a top plan view of the electrical connector according to the present invention without a tab disposed on the rear end thereof.
Figure 14:
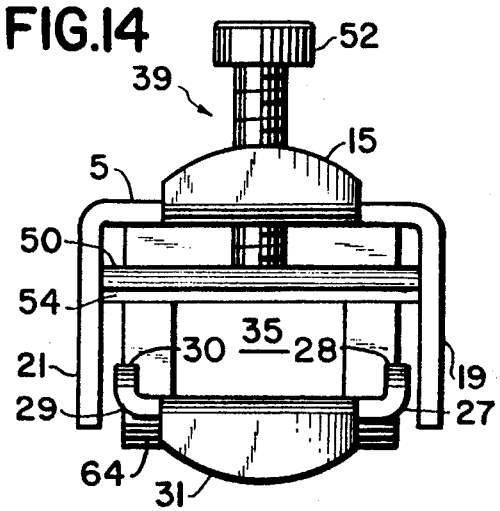
FIG. 14 is a front end elevation view of the electrical connector according to the present invention without a tab disposed on the rear end thereof.
Figure 15:
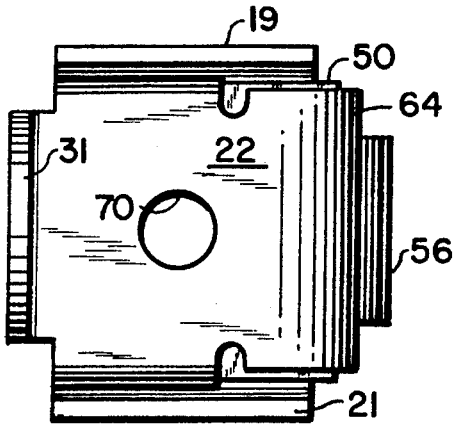
FIG. 15 is a bottom plan view of the electrical connector according to the present invention without a tab disposed on the rear end thereof.
Figure 16:
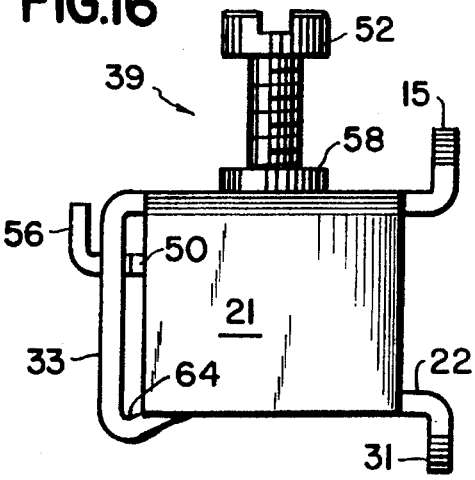
FIG. 16 is a right side elevation view of the electrical connector according to the present invention without a tab disposed on the rear end thereof.
Figure 17:
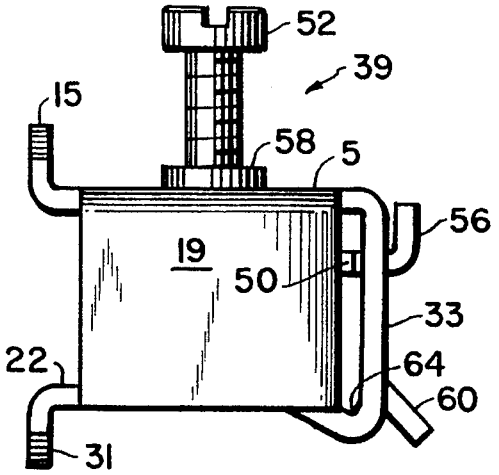
FIG. 17 is a left side elevation view of the electrical connector according to the present invention with a tab disposed on the rear end thereof.
Figure 18:
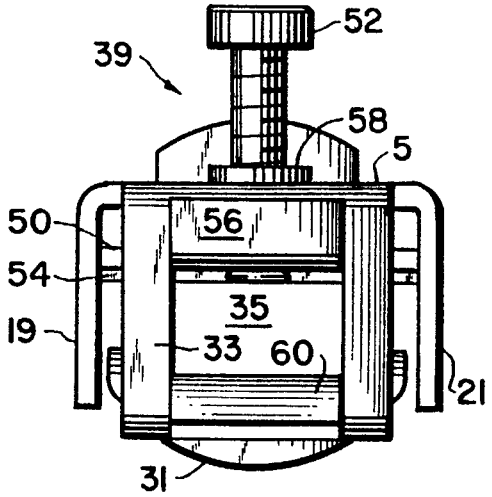
FIG. 18 is a rear end elevation view of the electrical connector according to the present invention with a tab disposed on the rear end thereof.
Figure 19:
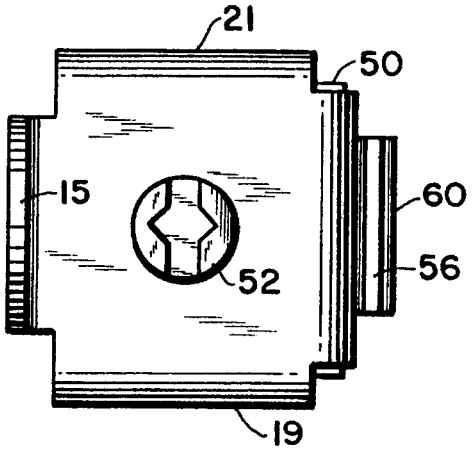
FIG. 19 is a top plan view of the electrical connector according to the present invention with a tab disposed on the rear end thereof.
Figure 20:
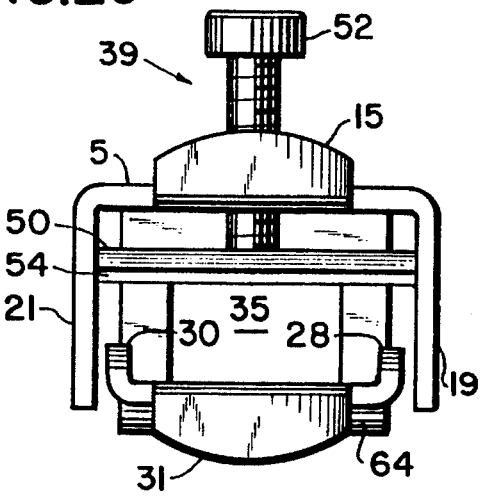
FIG. 20 is a front end elevation view of the electrical connector according to the present invention with a tab disposed on the rear end thereof.
Figure 21:
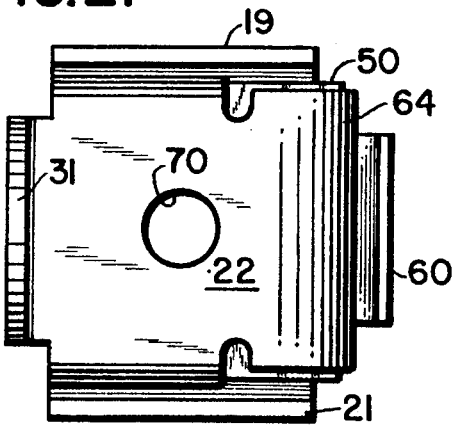
FIG. 21 is a bottom plan view of the electrical connector according to the present invention with a tab disposed on the rear end thereof.
Figure 22:
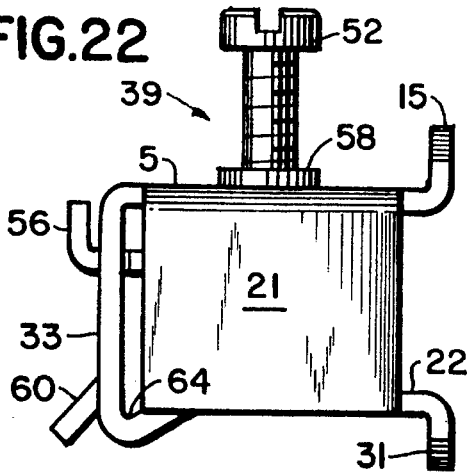
FIG. 22 is a right side elevation view of the electrical connector according to the present invention with a tab disposed on the rear end thereof.

Adjustable plate 50, as best seen in FIGS. 2 and 8, comprises an angled portion 54 disposed about the end of adjustable plate 50 which is closest to the front edges (9, 25) of top and bottom portions (5, 22) of connector body 3, and a tab portion 56 disposed substantially perpendicular about end of adjustable plate 50 which is opposite to angled portion 54. Adjustable plate 50 is disposed within connector body 3 such that tab portion 56 passes exits connector body 3 via through-hole 35 in rear end 33.

Top portion 5 preferably comprises a threaded hole 58 centrally disposed therein for receiving saddle screw 52 which is capable of reciprocally moving adjustable plate 50 in a substantially parallel plane with respect to top and bottom portions (5, 22). When saddle screw 52 is disposed within top portion 5, the angled portion 54 of adjustable plate 50 is angled downward away from top portion 5 and tab 56 is perpendicularly disposed upward toward top portion 5 so as to provide a physical barrier to internal intrusion into connector body 3 subsequent to securing of cable 37 therein. Rear end 33, optionally, comprises a tab or lip 60 connected at or about lower edge 62 of through-hole 35. Bottom portion 22 of connector body 3 preferably comprises an angled stiffening portion 64 disposed substantially adjacent to rear end 33 of connector body 3. The purpose of angled stiffening portion 64 is two-fold: (1) it provides sufficient stiffening to bottom portion 22; and (2) it allows for the use of additional material in the lower portion of rear end 33, thereby allowing for a larger through-hole 35 without the loss of structural integrity in rear end 33.

Adjustable plate 50 preferably includes a centrally disposed through-hole 66 capable of receiving saddle screw 52 therein. Saddle screw 52 is preferably affixed within through-hole 66 by means of swaging the end of screw 52 or any other known means of affixing it thereto which permits adjustable plate 50 to freely tilt and rotate relative to screw 52. Through-hole 70, which is centrally disposed within bottom portion 22, can be used to assist in the swaging of screw 52 by allowing a swaging instrument to have ready access to the end of screw 52 which passes through adjustable plate 50. It is also preferable that adjustable plate 50 has a raised portion 68 disposed between tab 56 and angled portion 54, wherein raised portion 68 is disposed on the surface of adjustable plate 50 which is facing the downwardly sloping angled portion 54. Angled portion 54 has a dual function of stiffening bottom portion 22 and assisting in the clamping of cable 37 against bottom portion 22. Raised portion 68 protrudes from the surface of adjustable plate 50 approximately the same distance as angled portion 54. Having such a raised portion 68 permits adjustable plate 50 to be aligned substantially in parallel with top and bottom portions (5, 22) when adjustable plate 50 is securely affixed about cable 37. Raised portion 68 also acts to securely clamp cable 37 between adjustable plate 50 and bottom portion 22. Tab 56 provides stiffening to adjustable plate 50, while also covering through-hole 35 of rear end 33 to prevent external access within connector body 3.

In order to insure that connector 1 is adequately affixed to outlet box 17, tabs (15, 31) are perpendicularly disposed with respect to top and bottom portions (5, 22), respectively. To install connector 1 within a knockout disposed about a side wall of outlet box 17, either tab 15 or 31 is inserted within the knockout, then the top and bottom portions (5,22) are squeezed towards one another allowing the previously non-inserted tab 15 or 31 to be inserted within the knockout. After both tabs (5, 22) are disposed within the knockout, the pressure is removed from the top and bottom portions (5, 22) such that top and bottom portions (5, 22) expand away from one another so that the outer diameter between the ends of tabs (15, 31) is greater than the diameter of the associated knockout, thereby securing connector 1 to outlet box 17. Thereafter, cable 37 is inserted into connector 1 via through-hole 35 such that it passes from rear end 33 through connector body 3 into conduit box 17. Cable 37 is securely affixed within connector body 3 by tightening screw 52 such that cable 37 is securely disposed between adjustable plate 50 and the inner surface of bottom portion 22. Concurrently upon tightening of screw 52, tabs (15, 31) move in a direction opposite to one another such that connector 1 is securely affixed to outlet box 17. This is graphically shown in FIG. 6 wherein the diameter between the outer edges of tabs (15, 31) is greater than the diameter of the knockout which is depicted by dotted line "R".

The width of tabs (15, 31) is preferably between about 55 to 75%, more preferably between about 65–70%, of the diameter of the knockout of outlet box 17.

Cable 37 is preferably a flat, metallic or non-metallic sheathed, multi-conductor cable. Metallic sheathes are preferably formed from aluminum, while non-metallic sheathes are formed from plastic or rubbery materials.

While I have shown and described several embodiments in accordance with my invention, it is to be clearly understood that the same are susceptible to numerous changes apparent to one skilled in the art. Therefore, I do not wish to be limited to the details shown and described but intend to show all changes and modifications which come within the scope of the appended claims.

What is claimed is:

1. An electrical connector for use in connecting a cable to an outlet box comprises:

a connector body having a substantially rectangular or square box configuration, said connector body comprising: a top portion which comprises a rear edge, a front edge, a first side edge, a second side edge, and a first tab portion disposed about said front edge of said top portion; a first side wall connected to said first side edge of said top portion; a second side wall connected to said second side edge of said top portion; a bottom portion which comprises a rear edge, a front edge, a first side edge, a second side edge, and a second tab portion disposed about said front edge of said bottom portion, said tab portions adapted to engage opposing edges of an opening in said outlet box to secure said connector body to said outlet box; and a rear end which is connected to the rear edges of both said top and bottom portions, said rear end comprises a through-hole for receiving said cable therein; and a means for concurrently securing said cable disposed within said connector body and securing said connector body to said outlet box.

2. The electrical connector according to claim 1 wherein said means for concurrently securing said cable disposed within said con,rector body and securing said connector body to said outlet box comprises an adjustable plate disposed between said top and bottom portions of said connector body and a means for reciprocally moving said adjustable plate in a substantially parallel plane with respect to said top and bottom portions, wherein said means for reciprocally moving said adjustable plate is also capable of causing said top and bottom portions to move in opposite directions from each other so as to secure said connector body to said outlet box.

3. The electrical connector according to claim 2 wherein said adjustable plate comprises an angled portion disposed about the end of said adjustable plate which is closest to the front edges of said top and bottom portions of said connector body, and a tab portion substantially perpendicular about the end of said adjustable plate which is opposite to said angled portion.

4. The electrical connector according to claim 3 wherein said adjustable plate is disposed within said connector body such that said tab portion passes through said through-hole in said rear end.

5. The electrical connector according to claim 4 wherein said top portion further comprises a threaded hole centrally disposed therein for receiving said means for reciprocally moving said adjustable plate in a substantially parallel plane with respect to said top and bottom portions.

6. The electrical connector according to claim 5 wherein said angled portion of said adjustable plate is angled downward away from said top portion, and wherein said tab portion of said adjustable plate is perpendicularly disposed upward toward said top portion of said connector body.

7. The electrical connector according to claim 6 wherein said rear end comprises a third tab portion connected to the lower edge of said through-hole near said bottom portion of said connector body.

8. The electrical connector according to claim 6 wherein said bottom portion of said connector body comprises an angled stiffening portion disposed substantially adjacent to said rear end of said connector body.

9. The electrical connector according to claim 3 wherein said adjustable plate comprises a centrally disposed through-hole capable of receiving said means for reciprocally moving said adjustable plate.

10. The electrical connector according to claim 3 wherein said adjustable plate comprises a raised portion disposed between said tab portion and said angled portion, and wherein said raised portion is disposed on the surface of said adjustable plate which is adjacent to the direction of the angled portion.

11. The electrical connector according to claim 10 wherein said raised portion protrudes from the surface of said adjustable plate approximately the same distance as said angled portion.

12. The electrical connector according to claim 2 wherein said means for reciprocally moving said adjustable plate is a screw.

13. The electrical connector according to claim 1 wherein said first and second tabs portions are perpendicularly disposed with respect to said top and bottom portions, respectively.

14. The electrical connector according to claim 4 wherein said bottom portion further comprises a through-hole centrally disposed therein.

* * * * *